US006495505B1

(12) United States Patent
Reul et al.

(10) Patent No.: US 6,495,505 B1
(45) Date of Patent: Dec. 17, 2002

(54) UNIT DOSE SOFTENER DISPOSED IN WATER SOLUBLE CONTAINER

(75) Inventors: Joseph Reul, Heusy (BE); Juliette Rousselet, Glons (BE); Hoai-Chau Cao, Ans (BE); Alain Jacques, Heusy (BE); Alain Gourgue, Lincent (BE); Charles Schramm, Jr., Hillsborough, NJ (US); Amjad Farooq, Hillsborough, NJ (US); Jeffrey T. Epp, Mount Arlington, NJ (US); Marianne Zappone, Burlington, NJ (US); Arthur Wagner, Roselle Park, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/209,603

(22) Filed: Jul. 31, 2002

(51) Int. Cl.[7] ..... C11D 17/00

(52) U.S. Cl. ..... 510/296; 510/297; 510/327; 510/329; 510/330; 510/334; 510/391; 510/439; 510/501; 510/515

(58) Field of Search ..... 510/296, 297, 510/327, 329, 330, 334, 391, 439, 501, 515

(56) References Cited

U.S. PATENT DOCUMENTS

| | | | | | |
|---|---|---|---|---|---|
| 4,203,851 | A | * | 5/1980 | Ramachandran | 252/8.6 |
| 4,259,217 | A | * | 3/1981 | Murphy | 252/547 |
| 4,818,421 | A | * | 4/1989 | Boris et al. | 252/8.8 |
| 5,089,148 | A | * | 2/1992 | Van Blarcom et al. | 252/8.6 |
| 5,183,580 | A | * | 2/1993 | Lew et al. | 252/8.6 |
| 5,770,557 | A | * | 6/1998 | Bruhnke | 510/515 |
| 5,972,870 | A | * | 10/1999 | Anderson | 510/298 |

* cited by examiner

*Primary Examiner*—Necholus Ogden
(74) *Attorney, Agent, or Firm*—Richard E. Wanfeldt

(57) ABSTRACT

A water soluble container having disposed therein a granular fabric softener composition.

12 Claims, No Drawings

UNIT DOSE SOFTENER DISPOSED IN WATER SOLUBLE CONTAINER

FIELD OF THE INVENTION

This invention relates to wash cycle unit dose laundry compositions for softening or conditioning fabrics. More particularly, this invention relates to unit dose fabric softening compositions which is contained in a water soluble container suitable for use in the wash cycle of an automatic washing machine.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound which will adequately disperse in the wash water.

Although detergent compositions in the form of compacted granular tablets of various shapes have received much attention in the patent literature, the use of such tablets to provide a unit dose fabric softener which will soften or condition fabrics in the wash cycle without impairing detergency or otherwise compromise the cleaning benefits provided by the detergent composition is not known.

Another possible option for providing a unit dose softener apart from the wash cycle is to introduce the softening ingredients directly into the rinse cycle. But, for this type of product to be effective several practical requirements must be met. To begin with, the size and shape of the unit dose container must be readily compatible with the geometry of a wide variety of rinse cycle dispensers designed for home washing machines in order to insure its easy introduction into the dispenser. Moreover, in common with the general use of rinse cycle softeners, it is necessary to clean the rinse dispenser on a regular basis to avoid residue from accumulating within the dispenser or even, at times, prevent bacterial growth from occurring.

Still further, a unit dose composition for the rinse cycle must be formulated to readily dispense its contents upon contact with water in a period of time corresponding to the residence time of the unit dose in the dispenser, namely, the period of time during which water enters and flows through the rinse cycle dispenser. The aforementioned practical requirements have to date not been successfully met with any commercially available product and hence there remains a need in the art for a unit dose softener capable of activation in the rinse cycle.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569, 773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water.

The use of a unit dose wash cycle fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water soluble sachet must be soluble in the wash liquor before the end of the cycle.

SUMMARY OF THE INVENTION

The present invention provides a unit dose wash cycle fabric softening composition contained in a water soluble container for softening or conditioning fabrics in the wash cycle of an automatic washing machine, said unit dose comprising (a) a water soluble container; and (b) disposed in the water soluble container is granular fabric softener composition, the amount of composition being sufficient to form a unit dose capable of providing effective softening or conditioning of fabrics in the wash cycle of said washing machine, wherein said fabric softener composition comprises a treated clay, a perfume and a colorant.

The term "granular" as used herein in describing the fabric softener is intended to encompass relatively coarser granules varying in size from about 150 to 2,000 microns as well as finer powder having a size as small as 30 to 50 microns.

The term "fabric softener" is used herein for purposes of convenience to refer to materials which provide softening and/or conditioning benefits to fabrics in the wash cycle of a home or automatic laundering machine.

The granular fabric softener composition of the invention is preferably comprised of a fabric softening clay optionally in combination with an organic fatty softening material. Especially preferred fabric softeners comprise a clay mineral softener, such as bentonite, in combination with a pentaerythritol ester compound as further described herein. Useful combinations of such softener may vary from about 80%, to about 90%, by weight, of clay, and from about 10% to about 20%, by weight, of fatty softening material such as a pentaerythritol compound (often abbreviated herein as "PEC").

The present invention is predicated on the use of a treated montmorillonite-containing clay, preferably a treated bentonite, as herein defined, as an active softening ingredient in a unit dose softening composition for the wash cycle. The resultant unit dose composition has reduced tendency to gel on contact with water so that when used in conjunction with laundry detergent compositions it manifests improved dispersion properties in the wash water without having any adverse effect on its softening properties.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The present invention relates to a water soluble sachet containing a unit dose of a fabric softener composition, wherein the water soluble sachet is formed from a single layer of water soluble thermo plastic film such as a polyvinyl alcohol, wherein the inner surface of the film is in contact with the fabric softener composition.

The fabric softener composition contained in the water soluble sachet comprises approximately by weight:

(a) 87% to 98% of a clay mineral based softener comprising a bentonite clay and an organic fatty softening material;

(b) 0 to 10%, more preferably 0.5% to 6% of a perfume; and (c) 0 to 0.5%, more preferably 0.05% to 0.3% of a dye, wherein the composition contains less than 10 wt. %, preferably less than 8 wt. % water and the composition does not contain an anionic sulfate surfactant, an anionic sulfonate surfactant, a fatty acid, hexylene glycol or an amine oxide surfactant.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The clay mineral softeners include the montmorillonite-containing clays which have swelling properties (in water) and contain 7% to 15% moisture and which are of smectite structure, so that they deposit on fibrous materials, especially cotton and cotton/synthetic blends, such as cotton/polyester, to give such fibers and fabrics made from them a surface lubricity or softness. The best of the smectite clays for use in the present invention is bentonite and the best of the bentonites are those which have a substantial swelling capability in water, such as the sodium and potassium bentonites. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, it has been found that such non-swelling bentonites exhibit even better fabric softening than do the swelling bentonites, provided that there is present in the softening composition, a source of alkali metal or other solubilizing ion, such as sodium (which may come from sodium hydroxide, added to the composition, or from sodium salts, such as builders and fillers, which may be functional components of the composition). Among the preferred bentonites are those of sodium and potassium, which are normally swelling, and calcium and magnesium, which are normally non-swelling. Of these it is preferred to utilize calcium (with a source of sodium being present) and sodium bentonites. The bentonites employed may be produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. The bentonite and other such suitable swellable clays may be agglomerated to larger particle sizes too, such as 60 to 120 sieves, but such agglomerates are not preferred. For purposes of providing a treated bentonite in accordance with the invention, the initial bentonite starting material is selected to have relatively low gelling and swelling properties. Specifically, the starting material bentonite is selected to have the following initial properties: (a) a montmorillonite content of at least 85%; and (b) when the bentonite is activated with sodium ions, dried and ground to particles, the ground particles do not swell more than about 2.5 fold over a period of 24 hours when added to deionized water at room temperature. The ground particles of bentonite for purposes of determining swelling herein are particles at least 90% of equal to or less than about 75 microns in diameter.

A preferred clay is a calcium based bentonite: Quest Premium bentonite, grade QPC 300 manufactured by Colin Stuart Minchem. This white bentonite contains maximum 5% cristobalite and 2% quartz and has a minimum base exchange capacity of 70 meq/100 g. Particle size is below 53 microns (98.5%) and the free moisture is maximum 14%.

A main component of the invented compositions and articles of the present invention, and which is used in combination with the fabric softening clay is an organic fatty softener. The organic softener can be anionic, cationic or nonionic fatty chains ($C_{10}$–$C_{22}$ preferably $C_{12}$–$C_{18}$). Anionic softeners include fatty acids soaps. Preferred organic softeners are nonionics such as fatty esters, ethoxylated fatty esters, fatty alcohols and polyols polymers. The organic softener is most preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound is often abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds (PEC's) are preferably partial esters. And more preferably there will be at least two free hydroxyls thereon after esterification (on the pentaerythritol, oligomer or alkoxyalkane groups). Frequently, the number of such free hydroxyls is two or about two but sometimes it may by one, as in pentaerythritol tristearate. The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as tallow or coconut oil, or from such natural materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of some esters (PEC's) within the present invention follow:

Monopentaerythritol Esters

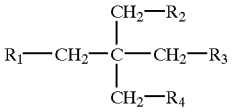

Monopentaerythritol Dilaurate $R_1=CH_3—(CH_2)_{10}—COO—$ $R_2=CH_3—(CH_2)_{10}—COO—$ $R_3=OH$ $R_4=OH$ Monopentaerythritol Monostearate $R_1=CH_3—(CH_2)_{16}—COO—$ $R_2=OH$ $R_3=OH$ $R_4=OH$ Monopentaerythritol Distearate $R_1=CH_3—(CH_2)_{16}—COO—$ $R_2=CH_3—(CH_2)_{16}—COO—$ $R_3=OH$ $R_4=OH$ Monopentaerythritol Tristearate $R_1=CH_3—(CH_2)_{16}—COO—$ $R_2=CH_3—(CH_2)_{16}—COO—$ $R_3=CH_3—(CH_2)_{16}—COO—$ $R_4=OH$ Monopentaerythritol Monobehenate $R_1=CH_3—(CH_2)_{20}—COO—$ $R_2=OH$ $R_3=OH$ $R_4=OH$ Monopentaerythritol Dibehenate $R_1=CH_3—(CH_2)_{20}—COO—$ $R_2=CH_3—(CH_2)_{20}—COO—$ $R_3=OH$ $R_4=OH$ Dipentaerythritol Esters

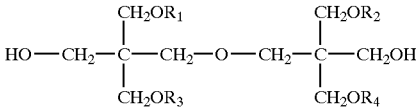

Dipentaerythritol Tetralaurate $R_1=CH_3—(CH_2)_{10}—CO$ $R_2=CH_3—(CH_2)_{10}—CO$ $R_3=CH_3—(CH_2)_{10}—CO$ $R_4=CH_3—(CH_2)_{10}—CO$ Dipentaerythritol Tetrastearate $R_1=CH_3—(CH_2)_{16}—CO$ $R_2=CH_3—(CH_2)_{16}—CO$ $R_3=CH_3—(CH_2)_{16}—CO$ $R_4=CH_3—(CH_2)_{16}—CO$ Pentaerythritol 10 Ethylene Oxide Ester

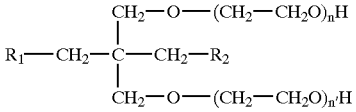

with n+n'=10

Monopentaerythritol 10 Ethylene Oxide Distearate $R_1=CH_3—(CH_2)_{16}—COO—$ $R_2=CH_3—(CH_2)_{16}—COO—$ Pentaerythritol 4 Propylene Oxide Esters

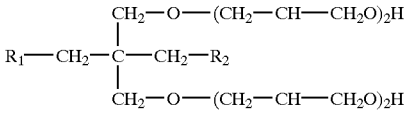

Monopentaerythritol 4 Propylene Oxide Monostearate $R_1=CH_3—(CH_2)_{16}—COO—$ $R_2=OH$ Monopentaerythritol 4 Propylene Oxide Distearate $R_1=CH_3—(CH_2)_{16}—COO—$ $R_2=CH_3—(CH_2)_{16}—COO—$ Although in the formulas given herein some preferred pentaerythritol compounds that are useful in the practice of this invention are illustrated it will be understood that various other such pentaerythritol compounds within the description thereof may also be employed herein, including such as pentaerythritol dihydrogenated tallowate, pentaerythritol ditallowate, pentaerythritol dipalmitate, and dipentaerythritol tetratallowate.

To enhance the softening efficacy of the unit dose compositions described herein cationic softeners such as conventional quaternary ammonium softening compounds may optionally be added in minor amounts.

The combination of bentonite and organic fatty softening material is generally from about 10% to about 100% bentonite and from about 1% to about 100% fatty softening material, preferably from about 50% to about 95% bentonite and about 5% to about 50% fatty softening material, and most preferably from about 80% to 90% bentonite and from about 10% to about 20% fatty softening material.

Other useful ingredients for the unit dose granular compositions of the invention include disintegration materials to enhance the disintegration of the unit dose in the wash water. Such materials include an effervescent matrix such as citric acid combined with baking soda, or materials such as PVP polymer and cellulose. Granulating agents may be used such as polyethylene glycol; bactericides, perfumes, dyes and materials to protect against color fading, dye transfer, anti-pilling and anti-shrinkage. For purposes of enhancing the aesthetic properties of the final composition, cosmetic ingredients such as dyes, micas and waxes may be used as coating ingredients to improve the appearance and feel of the unit dose.

The water soluble container which can be in the form of a sachet, a blow molded capsule or other blow molded shapes, an injected molded ampoule or other injection molded shapes, or rotationally molded spheres or capsules are formed from a water soluble thermoplastic resin. Water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties. Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

Typical film properties are:

1. Tensile strength (125 mil, break, 50% RH)=4,700 to 5,700 psi
2. Tensile modulus (125 mil, 50% RH)=47,000 to 243,000 psi; preferred range is 140,000 to 150,000 psi
3. Tear resistance (mean) (ASTM-D-199gm/ml)= 900–1500
4. Impact strength (mean) (ASTM-D-1709, gm)=600–1,000
5. 100% Elongation (mean) (ASTM-D-882, psi)= 300–600
6. Oygen transmission (1.5 mil, 0% RH, 1 atm)=0.0350 to 0.450 cc/100 sq. in./24 h
7. Oxygen transmission (1.5 mil, 50% RH, 1 atm)=1.20 to 1.50 cc/100 sq. in./24 h
8. 100% modulus (mean) (ASTM-D-882, psi)= 1000–3000
9. Solubility (sec) (MSTM-205,75° F.) disintegration= 1–15; dissolution=10–30

Typical resin properties are:

1. Glass Transition Temperature (°C.)=28 to 38; preferred is 28 to 33,
2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monosol 7030 or Monosol 8630

Reels of slit film are fed to a form, fill, seal machine (FFS). The Form, Fill, Seal machine (FFS) makes the appropriate sachet shape (cylinder, square, pillow, oval, etc.) from the film , fills the sachet with product, and seals the sachet. There are many types of form fill seal machines that can convert water soluble films, including vertical, horizontal and rotary machines. To make the appropriate sachet shape, one or multiple films can be used. The sachet shape can be folded into the film, mechanically deformed into the film, or thermally deformed into the film. The sachet forming can also utilize thermal bonding of multiple layers of film, or solvent bonding of multiple layers of film. When using poly(vinyl) alcohol the most common solvent is water. Once the appropriately shaped sachet is filled with product, the sachet can be sealed using either thermal bonding of the film, or solvent bonding of the film.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

Typical unit dose compositions for use herein may vary from about 5 to about 20 ml corresponding on a weight basis to about 5 to about 20 grams (which includes the weight of the capsule), and the number of doses per wash is two. Alternatively, when using 1 unit dose/wash, the corresponding volume and weight is from about 10 to about 40 ml and from about 10 to about 40 grams (including the capsule weight), respectively.

The following examples illustrate granular cleaning compositions of the described invention. Unless otherwise specified, the proportions in the film and elsewhere in the specification are by weight.

EXAMPLE 1

The following fabric softener composition formula was prepared in wt. % by simple mixing:

| | |
|---|---|
| White clay/PDT (comprising 15% of pentaerythritol distearate, 85% of Bentonite | 94.44 |
| Perfume | 3.63 |
| Blue dye | 0.14 |
| Water | 1.79% |

The above formulas were filed at a dosage of 15.5 g by the previously described method into a polyvinyl alcohol sachet having a film thickness of about 0.25 to 5 mils, more preferably 1 to 3 mils.

Dissolution tests were conducted in an European washing machine ( Miele Novotronic 935 super) at different temperatures (15 to 40° C.) with different laundry loads ( from 3.5 to 4.5 kg).

The different articles of the load were visually examined after 5 minutes washing. The complete dissolution of sachets was achieved : no residue was observed on the fabrics.

What is claimed is:

1. A cleaning system which comprises:

(a) a water soluble container which is formed from a polyvinyl alcohol;

(b) a fabric softener composition disposed in said water soluble container, wherein said fabric softener composition comprises approximately by weight:

(i) 87% to 98% of a clay based mineral softener comprising a bentonite clay and a pentaerythritol compound selected from the group consisting of a higher aliphatic acid ester, of pentaerythritol, an oligomer of pentaerythritol, and a lower alkylene oxide derivative of an oligomer of pentaerythritol, and mixtures thereof; and (ii) 1% to 10% of a perfume, wherein the composition contains less than 3.0 wt. % of water.

2. The system according to claim 1 wherein said container is a sachet, ampoule, capsule or sphere.

3. The system according to claim 2 wherein said composition contains a dye.

4. A cleaning system according to claim 1 wherein said montmorillonite-containing clay is a bentonite and said organic fatty softening material is a fatty alcohol.

5. A cleaning system according to claim 1 wherein said clay is at least partially coated with said organic fatty softening material and serves as a carrier for such fatty softening material.

6. A cleaning system according to claim 1 wherein said pentaerythritol compound is a higher aliphatic ester of pentaerythritol or of an oligomer of pentaerythritol.

7. A cleaning system according to claim 1 wherein the combination of bentonite and said pentaerythritol compound comprises, by weight, from about 50% to about 95% of bentonite and from about 5% to about 50% of said pentaerythritol compound.

8. A cleaning system according to claim 7 which comprises from about 80 to about 90% of bentonite and from about 10% to about 20% of said pentaerythritol compound.

9. A cleaning system according to claim 1 wherein said fabric softener further includes a liquid fatty ester.

10. A cleaning composition according to claim 9 wherein said fatty ester is sunflower oil.

11. A cleaning composition according to claim 1 wherein said fabric softener composition further includes a liquid silicone.

12. A cleaning composition according to claim 1 wherein said fabric softener composition further includes a liquid oleyl alcohol.

* * * * *